United States Patent [19]

Masuda et al.

[11] 4,148,280

[45] Apr. 10, 1979

[54] LIVESTOCK HOLDER

[76] Inventors: Hideo Masuda, 138, Takaoka-cho; Masayuki Matsuura, 464, Higashi-mikata-cho, both of Hamamatsu-shi, Shizuoka-ken, Japan

[21] Appl. No.: 748,304

[22] Filed: Dec. 7, 1976

[30] Foreign Application Priority Data

Dec. 8, 1975 [JP] Japan ..... 50-165405[U]

[51] Int. Cl.[2] ..... A61D 3/00

[52] U.S. Cl. ..... 119/103

[58] Field of Search ..... 119/103, 96; 269/328

[56] References Cited

U.S. PATENT DOCUMENTS

| | | | |
|---|---|---|---|
| 1,357,414 | 11/1920 | Olinger | 119/103 |
| 2,789,538 | 4/1957 | Merritt | 119/103 |
| 3,190,265 | 6/1965 | Geary | 119/103 |
| 3,970,046 | 7/1976 | Boggs | 119/103 |

*Primary Examiner*—Hugh R. Chamblee

*Attorney, Agent, or Firm*—McDougall, Hersh & Scott

[57] ABSTRACT

A livestock holder, for example, for castrating operation of pig, includes a pair of holding means driven by a drive means. The livestock is securely held at its body between both of the holding means in a desirable condition.

6 Claims, 10 Drawing Figures

LIVESTOCK HOLDER

BACKGROUND OF THE INVENTION

1. Field of the Invention

This invention relates to a livestock holder, and more particularly to livestock holder suitable for castrating operation of pig.

2. Description of the Prior Art

With the advance of the pig farming, various kinds of technical methods are employed in breeding the livestock with high calorie feed to obtain the meat of good quality in short time. As an important step for obtaining the meat among them, it is common knowlege in veterinary business and the hog raising industry to castrate the male pig.

However, the way of holding the pig during castrating operation remains unchanged or conventional, which is to hold the pig by hands or to tie the pig with a rope to a stke.

Such way is disadvantageous in safety and security. It oftens happens that the pig leg bone is put out of its joint or is broken. Or it often happens that the pig leg becomes swollen or is damaged at its Achilles' tendon. It requires great force to hold the pig. The operation is inefficient. It is difficult to castrate many pigs in continuous operation. The holding method is unstable, and insanitary. Daily works for holding the pigs are troublesome.

SUMMARY OF THE INVENTION

Accordingly, it is an object of this invention to provide a livestock holder with which a livestock such as a pig or the like can be very easily, safely, securely held, whereby the castrating operation or the like for the livestock can be effectively performed without any anxiety.

Another object of this invention is to provide a livestock holder with which a livestock can be alwaya safely and securely held in regardless of difference in form of each livestock, thereby such inconvenience that the insecure holding condition of the livestock is caused in dependence on different sizes of the livestocks, can be avoided, and such troubles that the castrating operation or the like can not be carried out because of the unexpected movement of the livestock, or that the livestock falls off from the holding arms, can be prevented.

A still further object of this invention is to provide a livestock holder with which a livestock can be held without anxiety for such tissues of the live body as the cutis, tendons, nerves, blood vessels, muscles or the like of the livestock to be injured.

A still further object of this invention is to provide a livestock holder with which a livestock can be held and released from the holding with ease by sole operator.

A still further object of this invention is to provide a livestock holder which is simple in construction and manufacturing and reliable and secure in operation.

A still further object of this invention is to provide a livestock holder with which a head of a livestock can be safely held upon holding the livestock.

A still further of this invention is to provide a livestock holder with which a livestock can be safely and reliably held with its head always secured steadily, in regardless of difference in form of each livestock.

A still further object of this invention is to provide a livestock holder which can be folded up to be of small size when being out of use, thereby it is very convenient for carriage and storage.

According to an aspect of this invention, there is provided a livestock holder including a pair of holding means, at least one of said means being able to move toward and away from the other; and a driving means for driving the one of the holding means, whereby a livestock is held with its body put between both of the holding means.

According to the above feature of this invention, the holding of the livestock can be achieved only with the operation which includes the steps of laying a livestock such as a pig between the holding means and of operating the driving means. The operation is easier than a conventional operation, and can be accomplished by sole operator. Moreover, since the livestock is held with the body put between the holding means, it can be very easily securely held. There is therefore no trouble that the livestock get out of the holder when it struggles, thereby the castration or the like for the livestock can be effectively operated without any anxiety. That is very advantageous.

The above and other objects, features and advantages of this invention, will be apparent from the following detailed description of illustrative embodiments which are to be read in connection with the accompanying drawings.

BRIEF DESCRIPTION OF THE DRAWINGS

Drawings show a livestock holder emboding the invention.

DESCRIPTION OF THE PREFERRED EMBODIMENT

Figure 1:
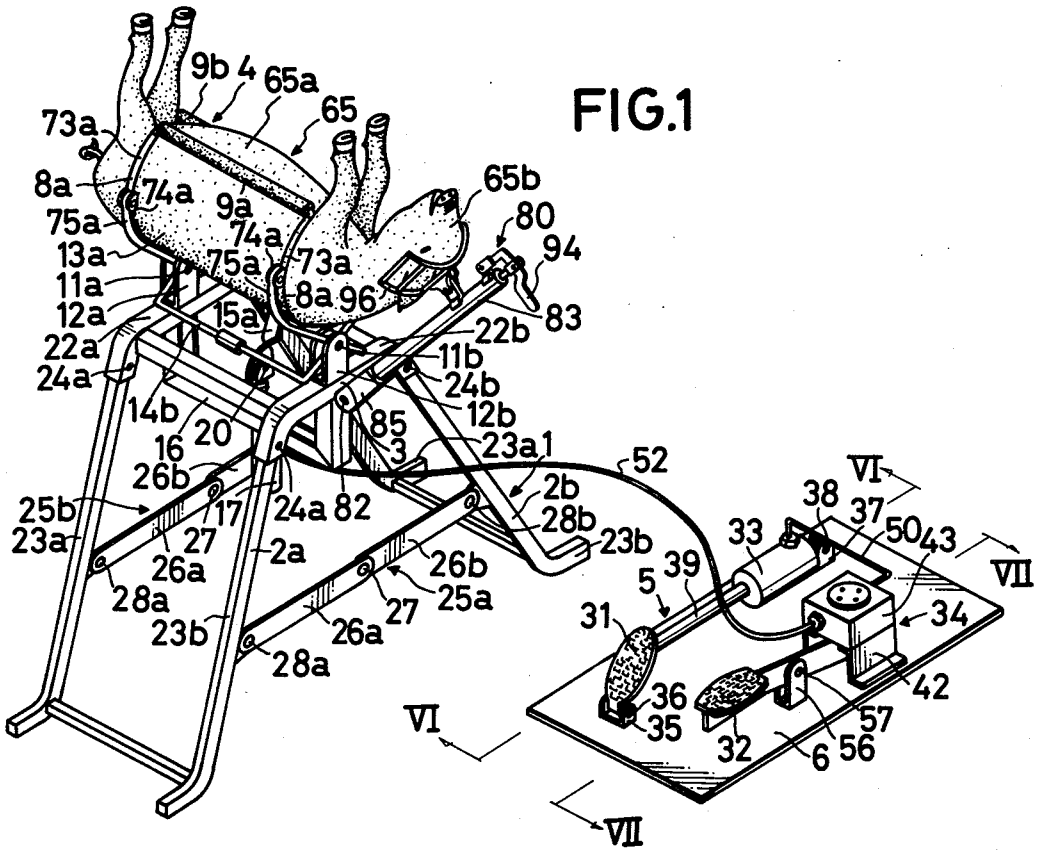
FIG. 1 is a perspective view of the livestock holder.
Figure 2:
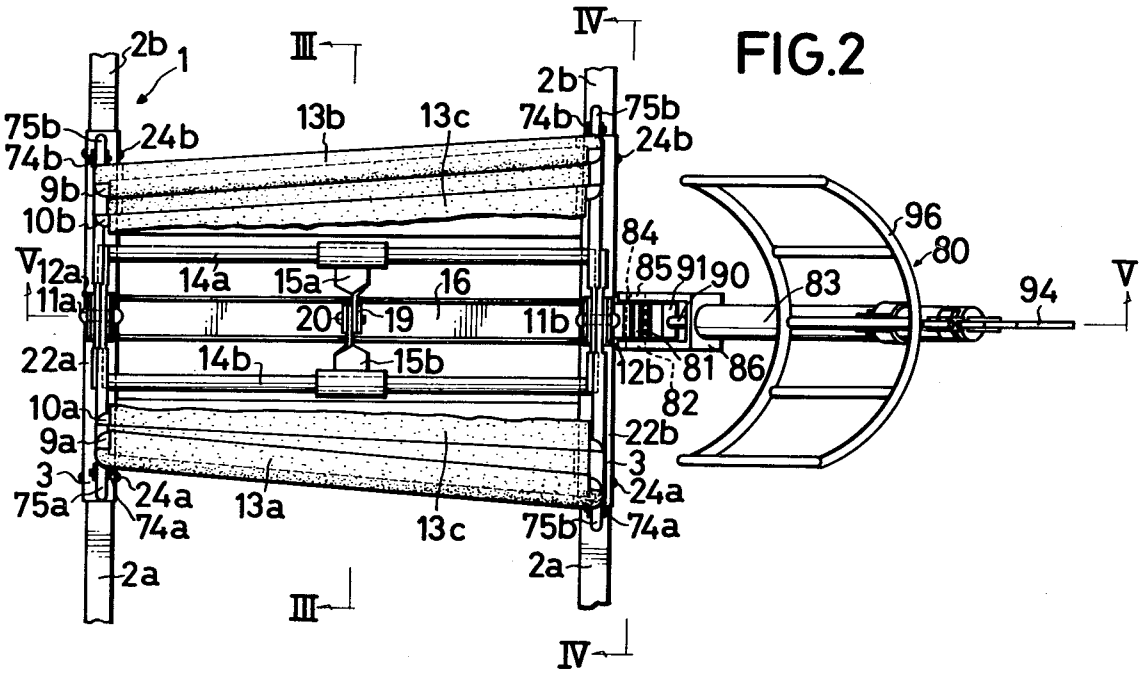
FIG. 2 is a plan view of the holding section of the livestock holder.

A preferred embodiment of this invention as applied to a livestock holder will now be described with reference to the drawings.

FIGS. 1 to 6 show one embodiment, in which reference numeral 1 designates a stand comprising a pair of folding legs 2*a* and 2*b* and a base support 3 which is supported by the legs 2*a* and 2*b*. These legs 2*a* and 2*b* and base support 3 are framed with tublar material and angular material. A holder 4 is supported on the base support 3, which is operated with a footpower operating section 5 positioned on a base plate 6, separately from the stand 1.

The holder 4 includes a pair of holding frames 8*a* and 8*b*, respectively formed of bar material shaped into rectangle, with their opposing vertical side portions 73a and 73b bent into arc. These holding frames 8a and 8b are so arranged that their upper connecting portions 9a and 9b are opposing horizontally to each other.

Hinge members 74a are attached to the middle portions of both side portions 73a of the holding frame 8a. Thus, the holding frame 8a is rotatably supported at the top ends of the pair of support arms 75a through the hinge members 74a. Similarly, hinge members 74b are attached to the middle portions of both side portions 73b of the holding frame 8b. Thus, the holding frame 8b is rotatably supported at the top ends of a pair of support arms 75b through the hinge members 74b.

The opposing pairs of support arms 75a and 75b are crossed into generally X-shape, and are rotatably supported on a pair of support frames 12a and 12b mounted on the base support 3, by a pair of support pins 11a and 11b aligned on the same axle at their crossing points.

Rubber sheets 13a and 13b are stretched across the holding frames 8a and 8b, respectively, conforming to the inner curvature of both side portions 73a and 73b. And another rubber sheet 13c is stretched between lower connecting portions 10a and 10b. The rubber sheets 13a to 13c may be made of various materials and preferably may be a laminate sheet with a relatively hard outer surface of tight matter and a relatively soft inner surface of spongy matter.

Figure 3:
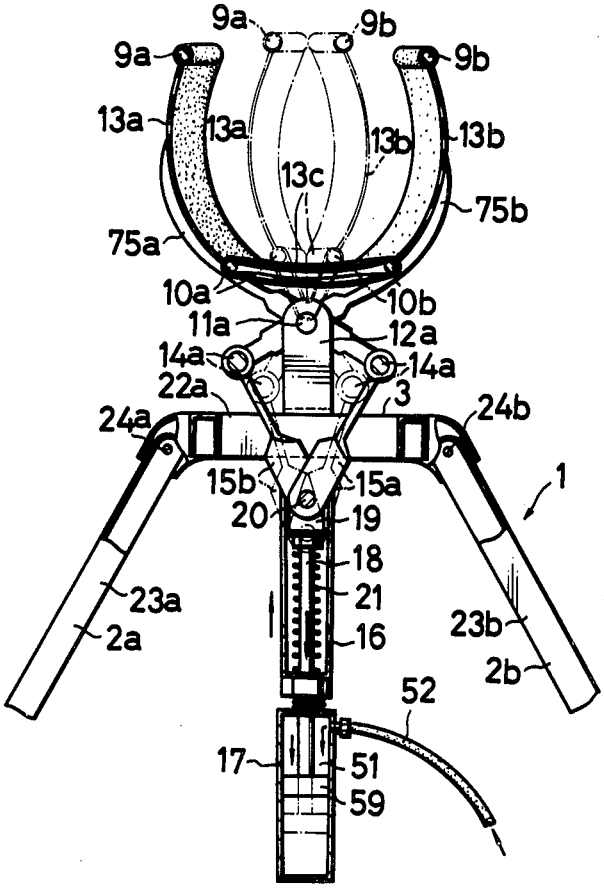
FIG. 3 is a cross-sectional view taken along the line III—III of FIG. 2.
Figure 4:
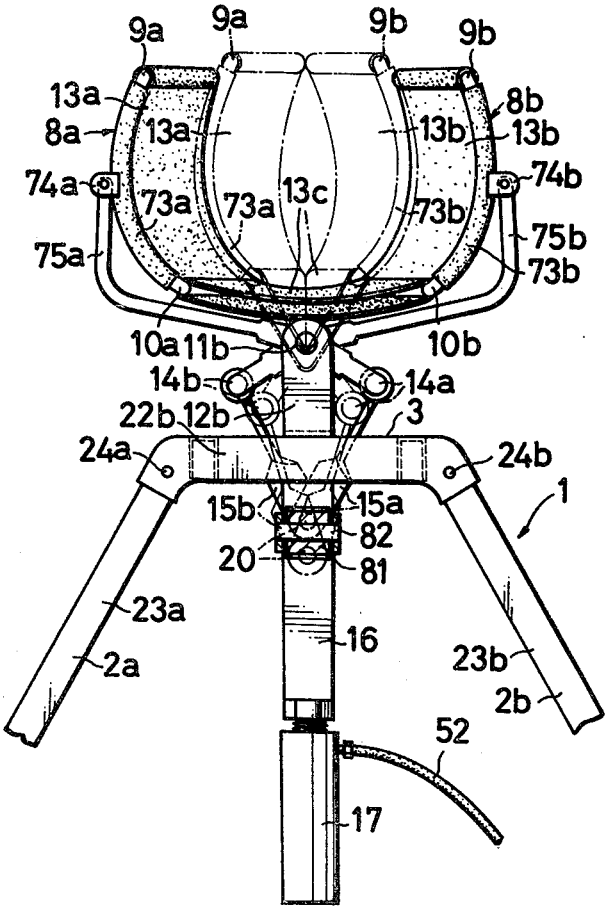
FIG. 4 is a sectional view taken along the line IV—IV of FIG. 2.
Figure 5:
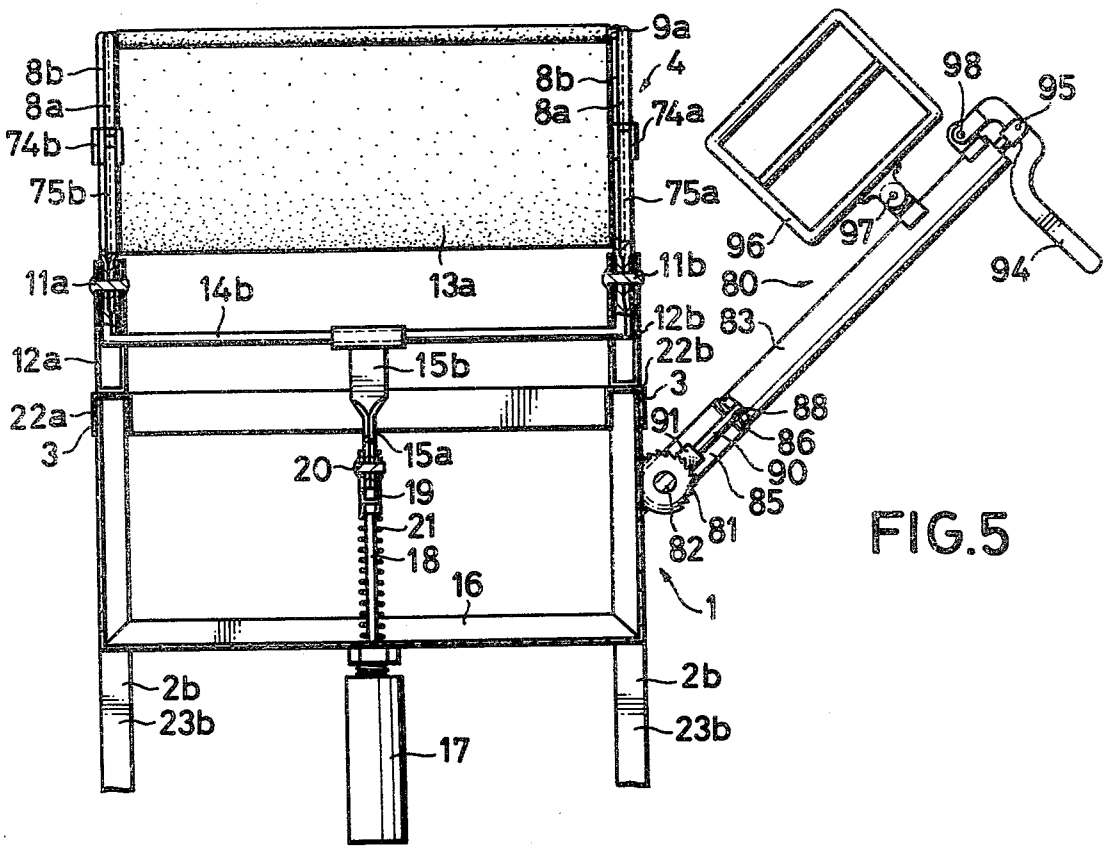
FIG. 5 is a longitudinal sectional view taken along the line V—V of FIG. 2.

Both lower ends of the support arms 75a and 75b are respectively interconnected by horizontal connecting portions 14a and 14b. A pair of links 15a and 15b are coupled to the support arms 75a and 75b near middle portions thereof, respectively. A cylinder mounting frame 16 is spaned under the base support 3 near the central portion thereof. Under the cylinder mounting frame 16 near the central portion thereof, as can be apparently seen in FIG. 5, a holding cylinder 17 as a hydraulic cylinder is vertically mounted. An upper end of a piston rod 18 extending upward from the holding cylinder 17 is interconnected with lower ends of both of the link 15a and 15b in common through a link 19 and a coupling pin 20. As shown in FIG. 3, a compression spring 21 is coiled round the piston rod 18 between the upper end of the piston rod 18 and the cylinder mounting frame 16 so as to urge upward the piston rod 18 with the compression force of the spring 21.

With the upward push of the piston rod 18 by the compression spring 21, the coupling pin 20 is pushed up through the link 19, as shown in FIG. 3. The pushing force of the coupling pin 20 is divided into two V-shaped directions through both links 15a and 15b, so that both of the connecting portions 14a and 14b are pushed upward and outward. Accordingly, as shown by solid lines in FIG. 3, the holding frames 8a and 8b are moved away from each other to the opened position.

A head holder 80 for holding the head of pig is mounted at one side of the support frame 12b.

Figure 8:
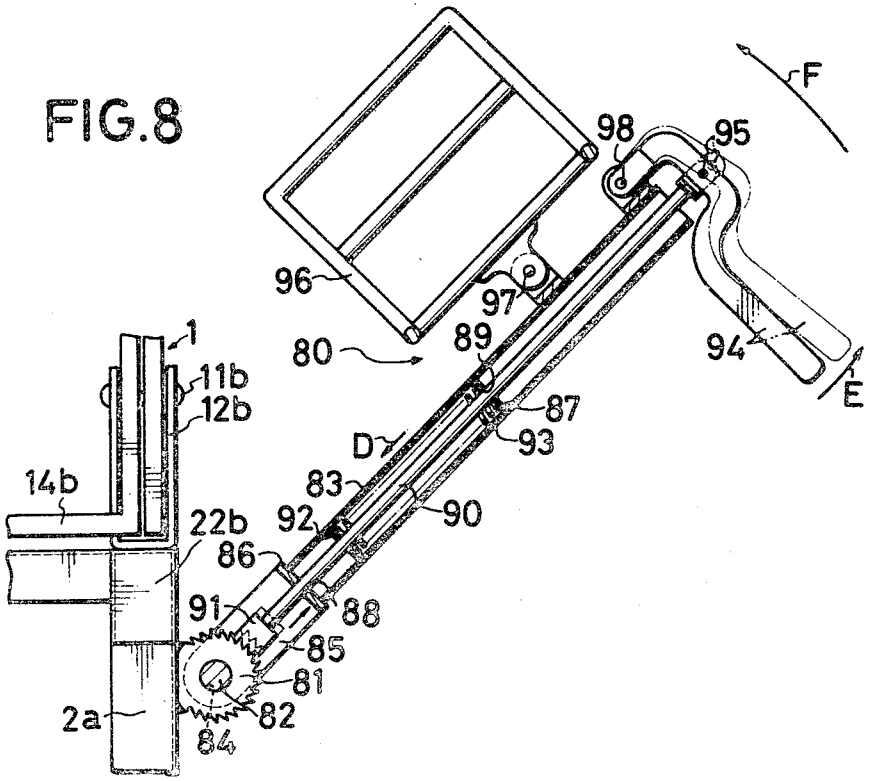
FIG. 8 is an enlarged sectional view of a head holder.

As can be seen in FIG. 8, a ratchet wheel 81 having a pin 82 is fixed at a predetermined position of the support frame 12. A head rest control member 83 having U-shaped cross-section is rotatably supported round both sides of the pin 82. Inside of the head rest control member 83, partitions 86 and 87 having through holes 88 and 89 at the center are provided at a predetermined interval. A stopper rod 90 is inserted through the through holes 88 and 89. At the lower end of the stopper rod 90, a click member 91 is attached, which engages with the ratchet wheel 81. A flange 92 is fixed to the stopper rod 90 at a predetermined position thereof, between the partitions 87 and 86. By means of the restoring force of a spring 93 arranged between the flange 92 and the partition 87, the stopper rod 90 is pressed in the direction shown by the arrow D of FIG. 8.

A handle 94 is attached to the upper end of the stopper rod 90 by a coupling pin 95. Further, a semicylindrical head rest 96 is rotatably mounted round a pin 97 to one side of the head rest control member 83. Thus, a head 65b of a pig 65 is placed on the head rest 96. The handle 94 is rotatably mounted to the upper portion of the head holder control member 83 by a pin 98. Thus, the handle 94 can be operated up and down round the pin 98, so that the click member 91 is deengaged from the ratchet wheel 81 when the stopper rod 90 is lifted up against the restoring force of the spring 98, with the upward operation of the handle 94.

When the head holder 80 is to be moved upward in the direction shown by the arrow F of FIG. 8, the operation is completed only by lifting the head rest control member 83 at its top end without operating the handle 94. Because, with the lift of the head rest control member 83, the engagement of the click member 91 with the ratchet wheel 81 is slipped out against the spring 93 one by one. Then, the click member 91 is again engaged with the ratchet wheel 81 by the restoring force of the spring 93 at the position where the head rest control member 83 is stopped. Thus, the head holder 80 is set at an appropriate position.

On the other hand, when the head holder 80 is to be set at a lower position, the operation is achieved by the upward push of the handle 94. The click member 91 is deengaged from the ratchet wheel 81 when the handle 94 is lifted upward in the direction shown by the arrow E of FIG. 8 against the compression spring 98. As a result, the head holder 80 becomes free to move up and down. Then the head holder 80 is rotated downward in the opposite direction to the arrow F, to a position where the head holder 80 is to be set. And the head holder 80 is fixed at an appropriate position by the engagement of the click member 91 with the ratchet wheel 81 when the handle 94 is separated from user's hand and is restored by the restoring force of the spring 93. Thus, the holding of the head 65b of the pig can be easily achieved by changing the angle of inclination of the head holder 80.

The legs 2a and 2b having the generally U-shaped cross section are provided on each side of the stand 1, as can be seen in FIG. 1. The pivotal connections between pairs of leg members 23a and 23b of each legs 2a and 2b and both end portions of a pair of leg connecting frames 22a and 22b of the base support 3 are formed, by pair of four support pins 24a and 24b which are alined on the same axles, respectively. A pair of folding links 25a and 25b are respectively spaned between the opposing leg members 23a and 23b of each of legs 2a and 2b. Each of the folding links 25a and 25b respectively comprises a pair of links 26a and 26b interconnected with each other by a coupling pin 27, and other ends of both links 26a and 26b are supported at the middle of the leg members 23a and 23b of the legs 2a and 2b, respectively by support pins 28a and 28b.

Accordingly, the legs 2a and 2b are unfolded to stand with a predetermined angle when the folding links 25a and 25b are horizontally expanded. And when both of the folding links 25a and 25b are bent into inversed V-shape by forcing up the coupled middle portions near the coupling pins 27 of the respective folding links 25a and 25b, the legs 2a and 2b can be folded inward pivotaly to the support pins 24a and 24b. Thus, the stand 1 can be compacted by folding the legs 2a and 2b. That is very convenient for carrying.

Figure 6:
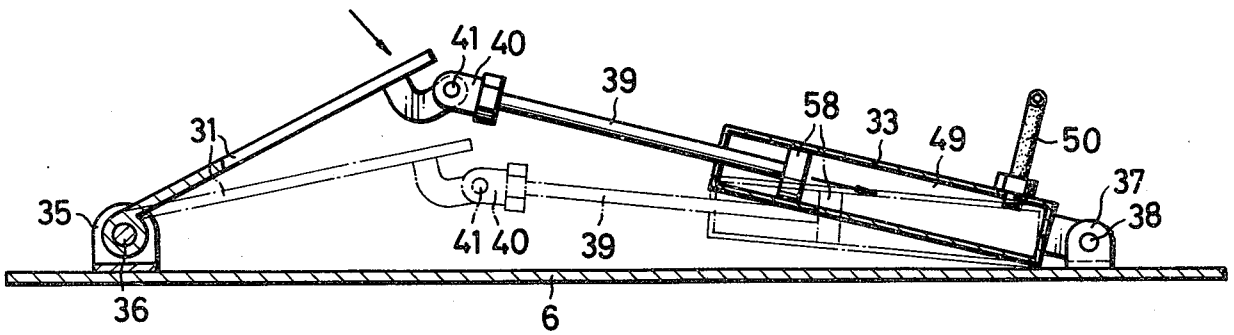
FIG. 6 is an enlarged sectional view taken along the line VI—VI of FIG. 1.

On the base plate 6, as shown in FIG. 1, there are provided two pedals 31 and 32, a pressure cylinder 33 as a hydraulic cylinder and a valve mechanism 34. The pedal 31 is pivotaly supported on a pedal support 35 mounted on the base plate 6, by a support pin 36. The pressure cylinder 33 is pivotaly supported on a cylinder support 37 mounted on the base plate 6, by a support pin 38. As shown in FIG. 6, the top end of a piston rod 39 of the pressure cylinder 33 is connected to the free end of the pedal 31, through a link 40, by a pin 41. The valve mechanism 34 is fixed on the base plate 6 by a pair of valve fixing members 42.

Figure 7:
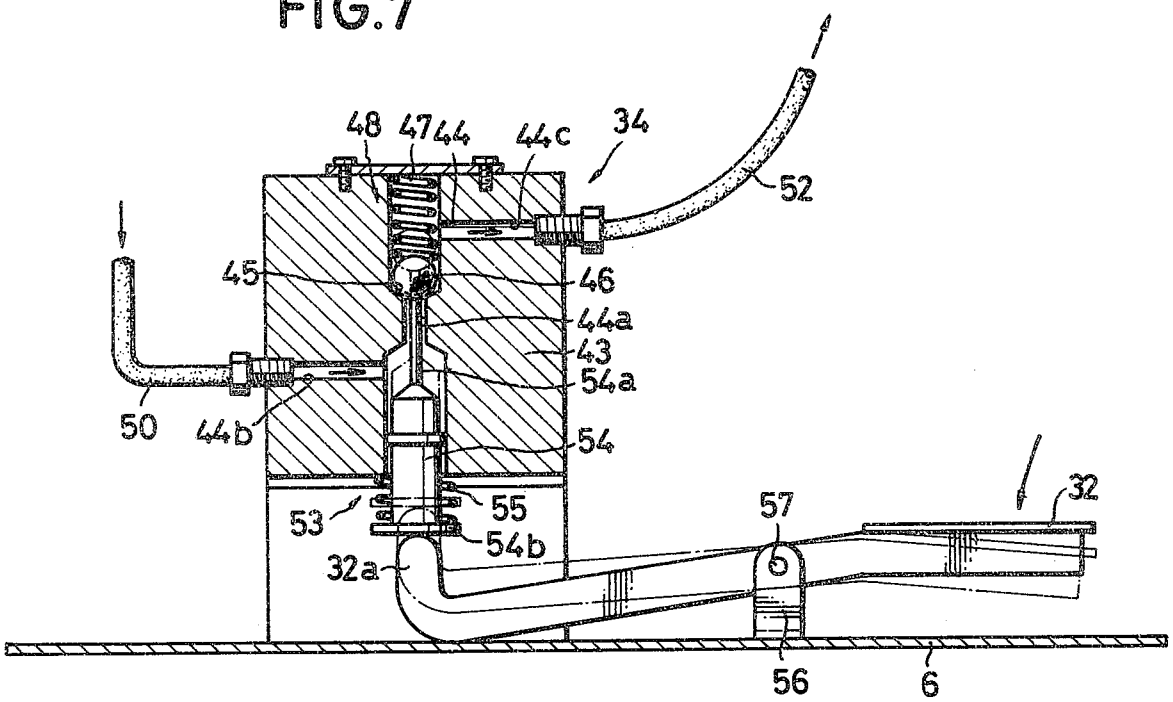
FIG. 7 is a sectional view taken along the line VII—VII of FIG. 1.

Referring to FIG. 7, a generally crank-shaped oil path 44 is formed in a valve casing 43. A steel ball 46 is put in the oil path to contact with a valve seat 45 formed near the upper portion of a vertical oil path 44a formed at the center of the valve casing 43. A compression spring 47 is provided to press the steel ball onto the valve seat 45. Therefore, a check valve 48 is made up of the steel ball 46 and the compression spring 47. In the oil path 44, a lower oil path 44b communicated with the lower part of the vertical oil path 44a is connected to a cylinder chamber 49 inside of the pressure cylinder 33 through a connecting tube 50. And an upper oil path 44c communicated with the upper part of the vertical oil path 44a is connected to a cylinder chamber 51 in the upper inside of the holding cylinder 17, through a connecting tube 52. The connecting tube is a flexible tube such as a rubber tube.

Accordingly, the check valve 48 functions as a nonreturn valve which prevents the reverse flow of the oil from the upper oil path 44c to the lower oil path 44b and makes it possible for the oil to flow only from the lower oil path 44a to the upper oil path 44c. A change-over mechanism 53 is further provided in the valve mechanism 34, which releases the function of the check valve 48 so as to permit the oil flowing reversely from the upper oil path 44c to the lower oil path 44b. The change-over mechanism 53 includes a vertically arranged valve rod 54, a compression spring 55 for biasing the valve rod 54 downward and a pedal 32. The valve rod 54 is positioned at the lower portion of the vertical oil path 44a, and can be slid up and down. The valve rod 54 had a pin portion 54a at the upper part thereof, which has slightly smaller diameter than the diameter of the vertical oil path 44a. The valve rod 54 is inserted from the bottom of the vertical oil path 44a, and the top end of the pin portion faces to the lower surface of the steel ball 46. Normally, the top end of the pin portion 54a is parted slightly below from the steel ball 46, as the valve rod 54 is urged downward by the compression spring 55.

The pedal 32 is supported on a pedal support 56 mounted on the base palte 6, by a support pin 57. The hooked end 32a of the pedal 32 is brought into contact with the lower end 54b of the valve rod 54. The pedal 32 is therefore rotated in the clockwise direction as shown in FIG. 7 by stepping thereon. The valve rod 54 is thrust up against the compression spring 55, and thus the pin portion 54a of the valve rod 54 pushes up the steel ball 46 against the compression spring 47. Consequently, the steel ball 46 is parted from the valve seat 45, resulting in the stoppage of the function of the check valve 48, which permits the double-flow of the oil between the lower oil path 44b and the upper oil path 44c.

Next, a method of using the above-mentioned livestock holder will be described. The livestock holder will be used, for example, to hold a pig with the face upward upon castrating operation of the pig.

First, a pig 65 is laid with the face upward on the rubber sheet 13c and with its body 65a positioned between the rubber sheets 13a and 13b. Upon such operation, the pig 65 can be easily placed on the rubber sheet 13c by hanging the pig inversely by its limbs. The whole operation is carried out by sole operater.

After the pig 65 is placed on the holder, the pedal 31 is stepped on to hold the pig. As the pedal 31 is rotated in the clockwise direction of FIG. 6 round the support pin 36, the piston rod 39 is pushed rightward in the pressure cylinder 33, with the counter-clockwise rotation of the pressure cylinder 33 round the support pin 38. Thus, pressure is applied to the oil in the cylinder chamber 49 by the piston 58.

The pressured oil flows into the vertical oil path 44a in the valve mechanism 34 through the connecting tube 50 and the lower oil path 44b, and pushes up the steel ball 46 against the compression spring 47 to flow into the oil path 44c. The oil further is fed into the cylinder chamber 51 of the holding cylinder 17 from the upper oil path 44c through the connecting tube 52.

As a result, the piston 59 of the holding cylinder 17 is pushed downward as shown by the doted-line in FIG. 3, which forces down the piston rod 18 against the compression spring 21. With the downward movement of the piston rod 18, the coupling pin 20 is pushed down through the link 19, so that the links 15a and 15b are forced down to give the action of levers to both of the support arms 75a and 75b. The support arms 75a and 75b rotate inward with each other round the support pins 11a and 11b as shown by the doted-line in FIGS. 3 and 4, into their closed position.

Thus, the body 65a of the pig 65 which is laid on the rubber sheet 13c with the face upward, is held with the pair of holding frames 8a and 8b, just as it is wrapped between the rubber sheet 13a and 13b. At the same time, the head 65b of the pig 65 is held at an appropriate position by the head holder 80.

On such operation, both of the support arms 75a and 75b are in circular arc motion, while both of the holding frames 8a and 8b are in parallel motion. The holding frames 8a and 8b therefore approach to each other in the state being kept in parallel with each other, so that the body 65a of the pig 65 is held between the right and left holding frames, in parallel from both sides. Accordingly, the body 65a can be steadily and securely held by the holding frames 8a and 8b in regardless of difference in form of each pig.

With the discontinuation of stepping on the pedal 31 with the foot, the pressurization by the pressure cylinder 33 is stopped. At that moment, since the steel ball 46 is pressured on to the valve seat 45 by the compression spring 47, the oil path 44 is shut off. As a result, the oil is prevented from flowing from the upper oil path 44c to the lower oil path 44b, so that the piston 59 of the holding cylinder 17 is locked in the pressured position. Thus, the holding frames 8a and 8b are locked in the state that the body 65a of the pig 65 is held therebetween. In such condition, as the holding frames 8a and 8b are powerfully actuated by the hydraulic cylinder, the pig 65 is tightly held at the body 65a with the face upward.

In such operation, the rib-portion in the body 65a of the pig 65 is held from behind just as it is wrapped with the rubber sheets 13a to 13c. The rib portion is so strong that there is not any problem in holding the rib portion tightly. Moreover, the pig 65 is held by the rubber sheets 13*a* to 13*c* so that it is possible to hold it for a long time more powerfully and safely, without injuring such tissues of the living body as the cutis, tendons, nerves, blood vessels, muscles or the like of the pig 65. Accordingly, there is no anxiety of the wrench of muscles, slipping or verebras, boneache of sacrums, rupture of the intervertebral disk, cutting of ligament or the like which may be caused by the struggle or exitement of the pig 65. Thus, the pig 65 is held in great safety.

Moreover, since the pig 65 is held with the face upward as above described, the anus is inverted below the testicles. Therefore, even though the pig 65 evacuates the bowels during the castrating operation, the wound is never contaminated by the excrement.

After the castrating operation, another pedal 32 is stepped on to release the holding of the pig 65. In the operation, the pedal 32 rotate in the clockwise direction of FIG. 7. And the hooked end 32*a* of the pedal 32 pushes up the valve rod 54 against the compression spring 55. As a result, the pin portion 54*a* of the valve rod 54 pushes up the steel ball 46 against the compression spring 47, so as to open the oil path 44.

Then, it becomes possible for the oil to flow reversely from the upper oil path 44*c* to the lower oil path 44*b*. The piston rod 18 is automatically forced up by the work of the compression spring 21 and the weight of the pig 65. Thus, in the opposite way as above, the oil which is pressure into the cylinder chamber 51 of the holding cylinder during the pressuring operation, is automatically returned into the cylinder chamber 49 of the pressure cylinder 33. Consequently, the holding frames 8*a* and 8*b* is restored again to the opened position shown by the solid line of FIG. 3, round the support pins 11*a* and 11*b*. The holding of the pig 65 is thereby released. At this time, with the reverse flow of the oil, the piston rod 39 of the pressure cylinder 33 is again forced back leftward in FIG. 6, and the pedal 31 is restored to the position shown by the solid line in FIG. 6.

Next, modifications of the holding section of the livestock holder will be described with reference to FIGS. 9 and 10.

Figure 9:
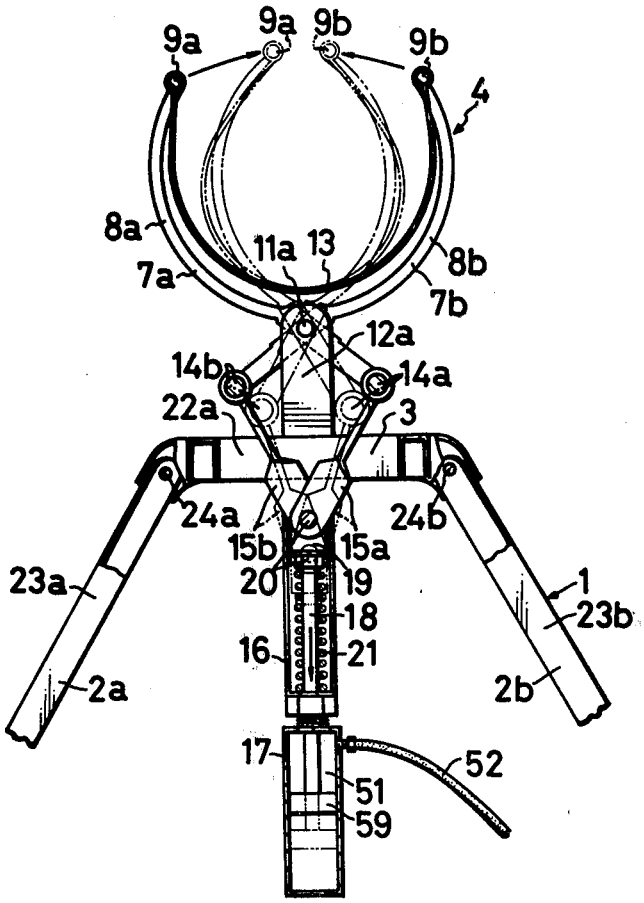
FIG. 9 is a cross-sectional view like FIG. 3, showing a modified version of the holding section of the livestock holder.

As with FIG. 3, FIG. 9 is a cross-sectional view of the holding section, where like reference numerals identify the corresponding elements. In FIG. 9, the holder 4 includes a pair of holding frames 8*a* and 8*b*, which are generally U-shaped bar material. The holding frames 8*a* and 8*b* are so arranged that their upper connecting portions 9*a* and 9*b* are opposing horizontally to each other. And pair of side portions 7*a* and 7*b* extending downward from the upper connecting portions 9*a* and 9*b* are crossed into X-shape. The holding frames 8*a* and 8*b* are rotatably supported on a pair of support frames 12*a* and 12*b* mounted on the base support 3, by a pair of support pins 11*a* and 11*b* aligned on the same axle at their crossing points. As shown in FIG. 9, the side portion 7*a* and 7*b* of the holding frames 8*a* and 8*b* are bent outward with an appropriate curvature. A rubber sheet 13 is stretched across the holding frames 8*a* and 8*b* along the inner curvature thereof, generally into U-shape. Both edges of the rubber sheet 13 are coiled around the upper connecting portions 9*a* and 9*b* to be secured thereto.

This modification gives advantages that the construction of the holder is simplified and the movement of the holder is more smoothed.

Figure 10:
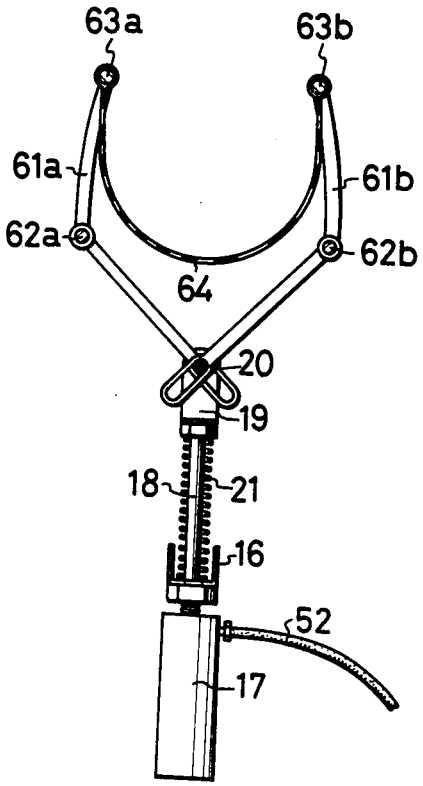
FIG. 10 is a cross-sectional view showing another modified version of the holding section of the livestock holder.

FIG. 10 shows a further modification of the holding section of the livestock holder.

In FIG. 10, a pair of holding frames 61*a* and 61*b* are supported by a pair of fixed supporting shafts 62*a* and 62*b* which are arranged at a predetermined interval. A rubber sheet 64 is stretched between the upper portions 63*a* and 63*b* of the holding frames 61*a* and 61*b*. A space is formed under the rubber sheet 64.

Therefore, this modification gives advantage that the back of the pig 65 is not brought into contact with the solid supporting shaft 62*a* and 62*b* and the frames when it is held by the holding frames 61*a* and 61*b* just as it is wrapped within the rubber sheet 64. Accordingly, the pig 65 can be held more safely. And it is possible to hold the pig 65 with face downward. That is very convenient when occasion demands.

According to the feature of this invention as above described, it is possible to hold the livestock with its body put between both of the holding arms in conformity with the form of the body. Therefore, the insecure holding of the livestock is never caused for every form of the livestock and thus the livestock can be always held in great safety and security. Accordingly, it never happens that the castrating operation or the like can not be carried out because of the unexpected movement of the livestock or that the livestock falls off from the holding arms. Thus, very effective, safety operation can be carried out.

According to the further feature of this invention, as above described, when the livestock is held with the body put between the holding means, the holding means are never directly brought into contact with the livestock. Moreover, the body of the livestock is elastically interposed between the holding means, so that the tissues of the live body (the cutics, tendons, nerves, blood vessels, muscles or the like) may be kept in safety from unexpected injuring. Accordingly, there is no anxiety of the wrench of muscles, slipping of vertebras, boneache of sacrums, rupture of the intervertebral disk, cutting of ligament or the like which may be caused by the struggle or excitement of the livestock. Thus, the livestock can be held in great safety.

According to the further feature of this invention as above described, sole operator may catch a livestock with his both hands, and the pedals can be stepped on by his foot to drive the pair of holding means for holding and releasing the holding of the livestock. Therefore, the operation can be completed by the sole operator with ease.

According to the further feature of this invention as above described, the livestock holding operation comprises only steps of actuating the actuating means to move a piston of the cylinder by a predetermined stroke, and then of releasing the actuating means to lock the oil in the pressured condition automatically with the working of the check valve, thereby the holding condition of the livestock is kept as it is. Accordingly, there need not to provide an additional locking means, resulting in simple construction and easy manufacturing. Moreover, since the reaction of holding force to the livestock is transmitted to the operator through the actuating means, the operator can advantageously recognize the adequate holding force in contrary to the case where a mechanical holding mechanism is employed. Accordingly, the operator can carry out the reliable and secure holding operation while always checking the holding force directly. Further, since the oil pressure can be released only by actuating the oil pressure releasing means, the operation for releasing the holding of the livestock can be performed with ease without any strong operating force.

According to the further feature of this invention as above described, the head of the livestock can be held with the head rest while its body being held with the holding means, resulting in more complete holding condition. Thus, there is no auxiety for the head and neck portion of the livestock to be injured. That further improves the safety.

According to the further feature of this invention as above described, the height of the head rest can be adjusted by adjusting the angle of inclination of the head rest adjusting member. Further, since the head rest is rotatably supported on the head rest supporting member so as to be able to turn the facing direction of the head rest to the head, the head rest can be preferably adjusted into the position to fit with the head of the livestock, even when the position of the head is slightly shifted owing to the difference in form of each livestock. Thus, the livestock can be safely and reliably held with its head always secured steadily.

And according to the further feature of this invention as above described, the relatively large base stand can be folded up to be of small-size and the whole is compacted to permit the easy carriage and storage.

A livestock holder according to this invention cannot only be applied to the castrating operation, but also to different operations such as an abdominal operation, a hernia operation, a proctocele and so on. And it may be applied to different livestocks beside the pig.

While there have been described preferred embodiments of the invention, obviously modifications and variations are possible in light of the above teachings. It is therefore to be understood that within the scope of the appended claims, the invention may be practiced otherwise than as specifically described.

What is claimed is:

1. A livestock holder comprising:

(A) a pair of holding means facing each other at their concave curved portions;

(B) a pivotal axis for rotatably supporting said pair of holding means at their lower portion, said curved portions of the holding means being moved away from, and toward each other upon rotation of said holding means around said pivotal axis;

(C) a spring means for urging said holding means so as to rotate around said pivotal axis in a direction to move said curved portions of the pair of holding means away from each other;

(D) a pedal means;

(E) a drive means for driving said pair of holding means concurrently against said spring means upon actuation of said pedal means to move said curved portions of the holding means toward each other;

(F) a first power transmitting means forming part of said drive means, said first power transmitting means being connected to said pedal means and actuated by said pedal means for driving said holding means;

(G) a second pedal means;

(H) a locking means for automatically locking said holding means at the driven position, whereby said livestock is bodily held between both of said holding means; and, (I) A second power transmitting means comprising part of said locking means, said second power transmitting means being connected to said second pedal means and actuated by said second pedal means to unlock said pair of holding means to allow the holding means to return to their original positions.

2. A livestock holder according to claim 1 in which said holding means each comprise a pair of supporting arms rotatably supported by said pivotal axis, and a pair of holding arms including said curved portions pivotally supported on the top end portions of said supporting arms, said supporting arms being rotated so as to move the respective pairs of said holding arms toward each other in a substantially linear direction whereby the livestock is held between both of said holding arms in conformity with the shape of the body of the livestock.

3. A livestock holder according to claim 1 in which said pair of holding means includes elastic material acting conformably on the body of said livestock.

4. A livestock holder according to claim 1 in which said holder further comprises a head rest to hold a head of said livestock which is held with the body secured by said holding means, a supporting member for supporting said head rest, said supporting member being rotatable to adjust the angle of inclination to a base stand on which said holding means is mounted, a handle means for adjusting said angle of the inclination of the supporting member, and a lock means for locking said supporting member at the adjusted angle.

5. A livestock holder according to claim 1 in which said holder further comprises a base stand on which said holding means is mounted, and including pairs of leg members connected to each other through folding links, said base stand being collapsable by means of said folding links.

6. A livestock holder according to claim 1 wherein said first power transmitting means comprises a first hydraulic cylinder, the oil pressure transmitted from said first hydraulic cylinder serving to drive said holding means, said second power transmitting means comprising a second hydraulic cylinder, an oil path interconnecting said hydraulic cylinders, said locking means comprising a check valve positioned in said oil path between said hydraulic cylinders, and an oil pressure releasing means, engagement of said second pedal means actuating said oil pressure releasing means for unlocking of said holding means.

* * * * *